United States Patent [19]

Crandell

[11] 4,307,551

[45] Dec. 29, 1981

[54] SYSTEM FOR CLADDING BUILDING EXTERIORS

[75] Inventor: Stephen L. Crandell, Kokomo, Ind.

[73] Assignee: PPG Industries, Inc., Pittsburgh, Pa.

[21] Appl. No.: 65,318

[22] Filed: Aug. 9, 1979

[51] Int. Cl.[3] ..... E04B 2/88

[52] U.S. Cl. ..... 52/235

[58] Field of Search ..... 52/508, 586, 235, 511, 52/506, 471, 475, 510, 772, 779, 778

[56] References Cited

U.S. PATENT DOCUMENTS

| | | | |
|---|---|---|---|
| 3,295,282 | 1/1967 | Belcher | 52/460 |
| 3,559,358 | 2/1971 | Lohse | 52/235 |
| 3,672,107 | 6/1972 | Santry | 52/235 |
| 4,070,835 | 1/1978 | Cochin | 52/235 |
| 4,107,887 | 8/1978 | Wendt | 52/235 |

FOREIGN PATENT DOCUMENTS

| | | | |
|---|---|---|---|
| 1014857 | 12/1965 | United Kingdom | 52/235 |

*Primary Examiner*—John E. Murtagh
*Attorney, Agent, or Firm*—Donald Carl Lepiane

[57] ABSTRACT

An exterior building cladding system has anchor and washer arrangements for securing horizontal furrings in spaced relation to one another and to the exterior of the building. Top hanger on inside surface of the panels is mounted on the horizontal furring and the bottom hanger of the top panels are joined to top hanger of adjacent bottom panel by a horizontal spline which mounts the horizontal furring. Side hangers of adjacent panel are joined together by a vertical spline.

10 Claims, 9 Drawing Figures

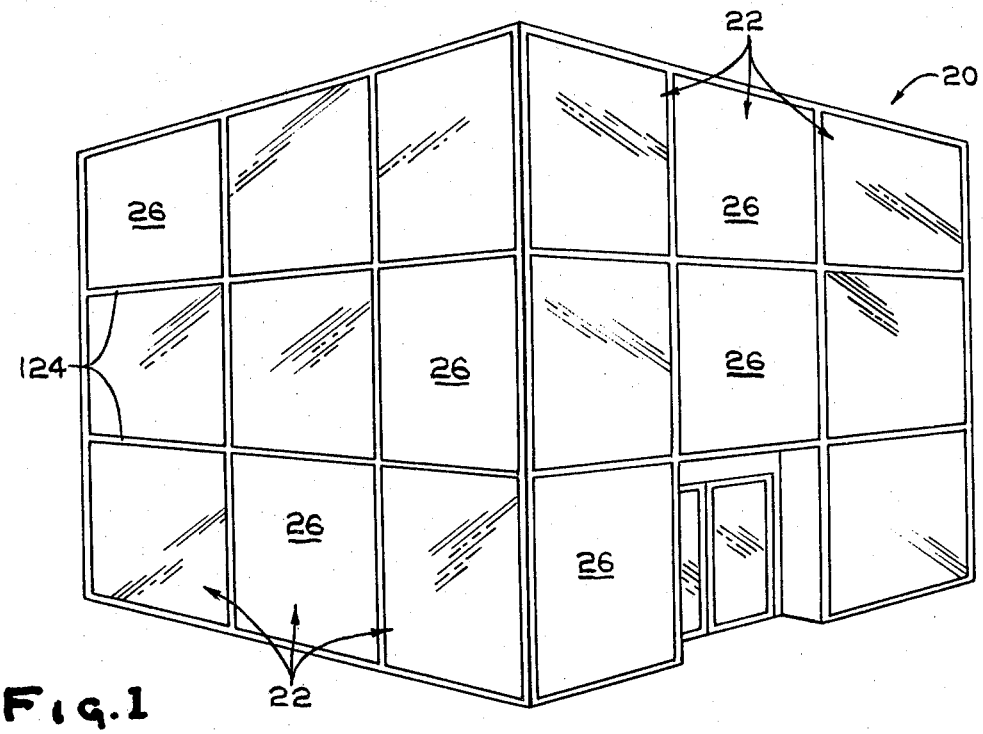
Fig. 1
Fig. 5
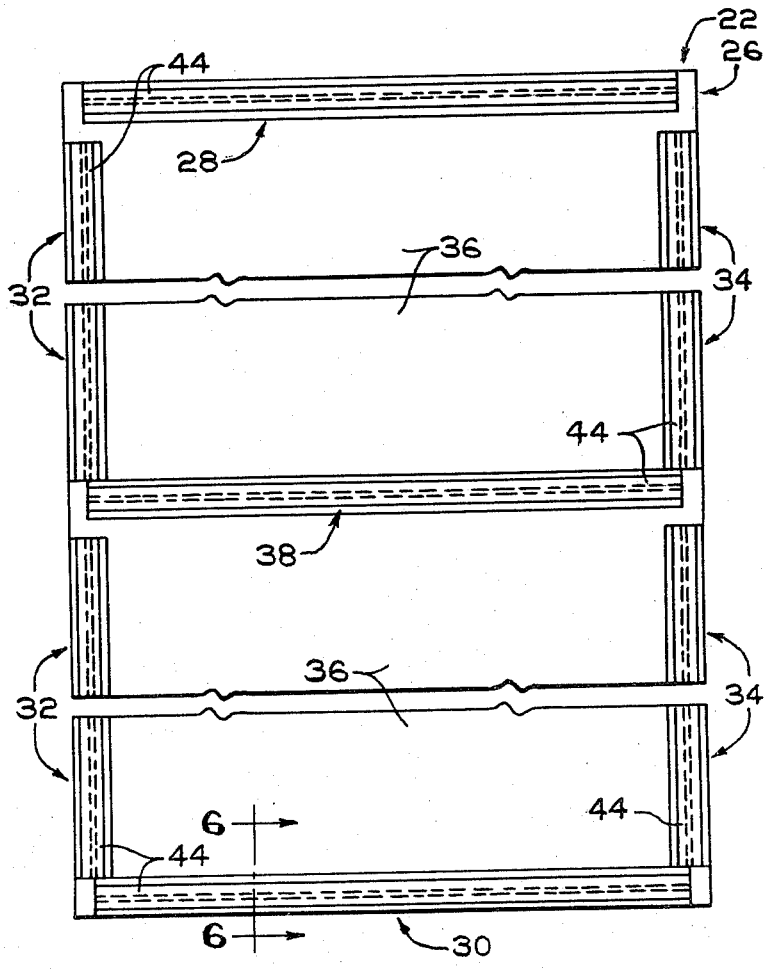
Fig. 6
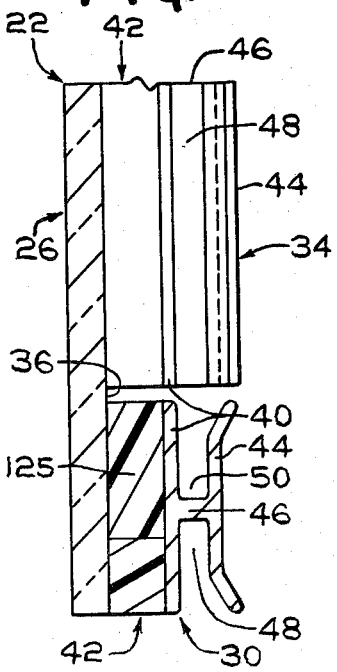

SYSTEM FOR CLADDING BUILDING EXTERIORS

BACKGROUND OF THE INVENTION

1. Field of the Invention

This invention relates to a system for cladding building exteriors.

2. Discussion of the Technical Problems

Increased cost of materials and labor have made it economical to clad the exterior of buildings with panels rather than raze the building and build a new one. An acceptable external cladding system requires suitable anchors to support the dead weight of the panels and the structural members in spaced relationship to the building exterior. Further, the cladding system should provide ease of replacing selected panels e.g. damaged panels. Since cladding systems having the above characteristics are not presently available in the prior art, it would be advantageous to provide one.

SUMMARY OF THE INVENTION

This invention relates to an anchor for securing cladding in spaced relationship to exterior wall of a building. The anchor includes a member and a washer each having a serrated surface portion. Facilities mounting the bulding wall urge the serrated surfaces of the washer and member against one another to secure same to the exterior of the building.

This invention also relates to a panel for use in a cladding system. The panel includes a sheet having at least one hangar secured a major surface of the sheet.

Still further, the invention relates to a method of cladding exterior of a building by securing spaced rows of support facilities to the building exterior and mounting top hangar of bottom panels on one row of the support facilities. Facilities join bottom hangar of adjacent top panels; top hangar of adjacent bottom panel; and support facilities together.

This invention also relates to a method of replacing selected panels of a cladding system by removing the panel to be replaced to provide an opening. Hangars having an adhesive layer are mounted around the opening. A sheet is mounted in the opening and urged against the hangers to flow the adhesive therebetween to secure the sheet to the hangars.

This invention also relates to a system for cladding the exterior surface of a building with panels having top and bottom hangars mounted on a major surface thereof. Facilities engagably supporting the top and bottom hangar are mounted in spaced relationship to the building. The facilities include an anchor securing elongated, horizontal hangar support members in spaced relation to the building.

BRIEF DESCRIPTION OF THE DRAWING

FIG. 1 is a perspective view of a building cladded in accordance to the teachings of the instant invention;

FIG. 5 is the inside view of a panel showing the relative position of hangars for mounting the panel on the support system of the instant invention;

FIG. 6 is a view taken along lines 6—6 of FIG. 5;

DESCRIPTION OF THE INVENTION

Figure 2:
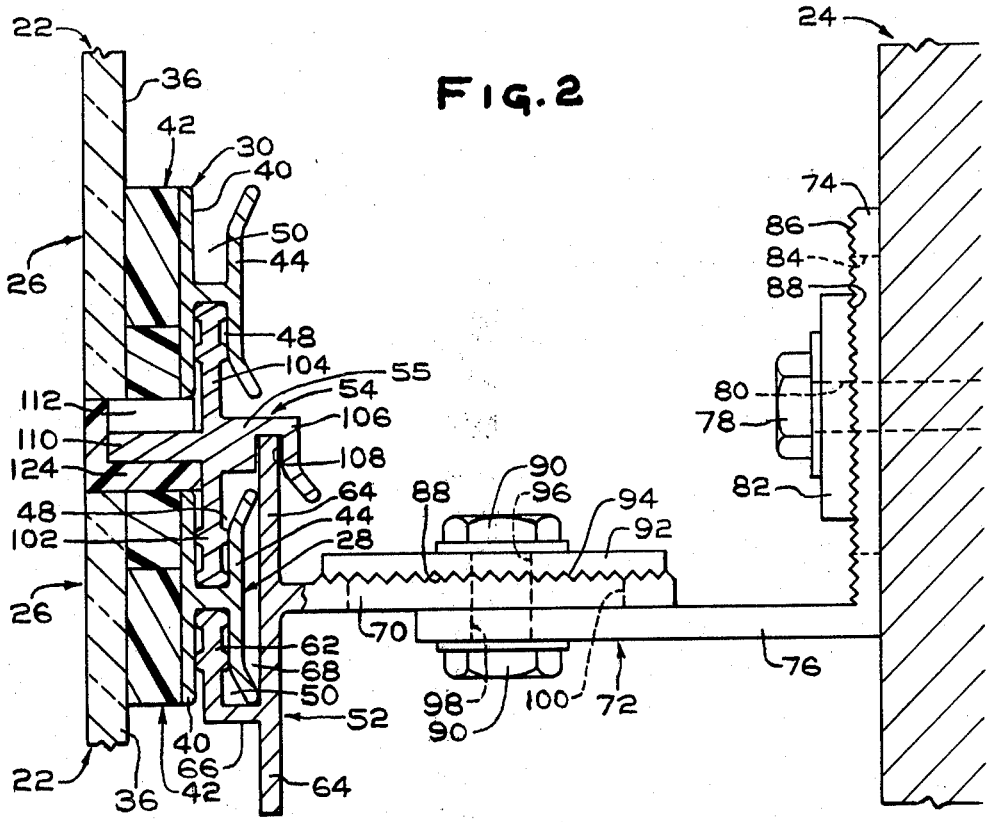
FIG. 2 is a side view of a panel support system for securing panels in position in spaced relationship to the building and incorporating features of the invention.
Figure 4:
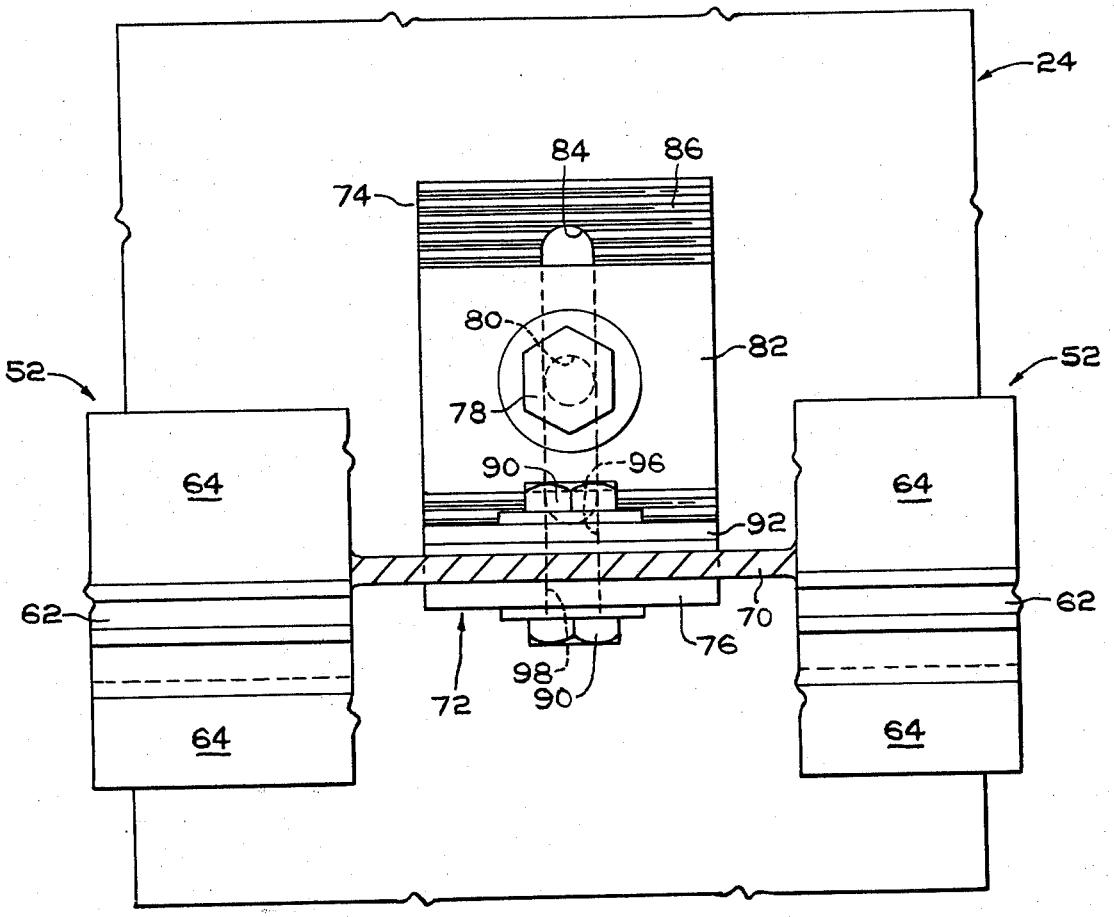
FIG. 4 is a partial front view having portions removed for purposes of clarity to illustrate the anchor of the support system incorporating features of the invention.

Shown in FIG. 1 is building 20 having outer panels 22 mounted in accordance to the teachings of the invention to former exterior wall 24, a portion of which is shown in FIGS. 2 and 4. With reference to FIG. 5, each of the panels 22 include a sheet 26 having a top hanger 28, a bottom hanger 30 and side hangers 32 and 34 secured to the interior surface 36 of the sheet 26. Although not limiting to the invention, an intermediate hanger 38 may be used to minimize bowing of the center portion of the sheet and provide additional structural stability to the mounted sheet. With reference to FIG. 6, the hangers 28, 30, 32, 34 and 38 are identical in construction and each include a base 40 secured in any convenient manner e.g. by adhesive layer 42 to the interior surface 36 of the sheet 26 and a facing member 44 spaced from the base 40 by leg 46 to provide an exterior groove 48 and an interior groove 50.

Figure 7:
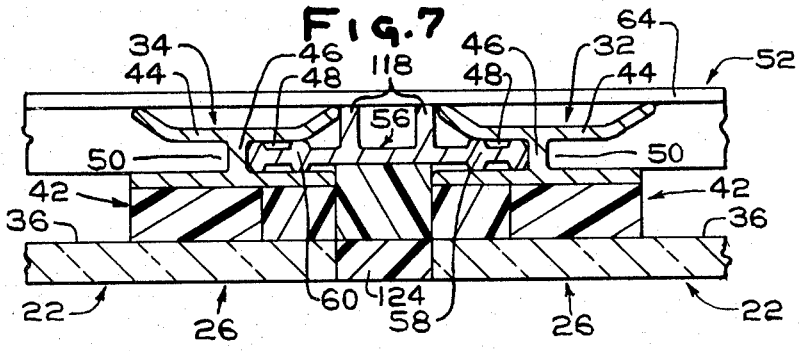
FIG. 7 is a partial top elevated view having portions removed for purposes of clarity illustrating the side retaining members of the support system.

Referring back to FIG. 2, the interior groove 50 of the top hanger 28 of the bottom panel 26 is mounted on horizontal furring 52 and horizontal spline 54 is mounted in the exterior groove 48 of the top hanger 28 of the adjacent bottom panel 26 and exterior groove 48 of the bottom hangar 30 of the top panel 26 as viewed in FIG. 2. With reference to FIG. 7, the exterior groove 48 of the side hangers 32 and 34 are mounted on a vertical spline 56 to be discussed below. The downward groove of the intermediate hanger 38 of the panel 26 as mounted which may be either the interior or exterior groove of the hanger 38 is mounted on a horizontal furring 52 in a similar manner as the top hanger 28 of the bottom panel as viewed in FIG. 2. As can now be appreciated, the hangers 30, 32, 34 and 38 do not use both the interior and exterior grooves 50 and 48 respectively. However, to avoid a mixup when mounting the hangers on the back of the sheet, it is recommended that the hangars have similar construction.

Referring back to FIG. 5, the top hanger 28, the bottom hanger 30 and intermediate hanger 38 have their ends spaced inwardly from the sides of the sheet so that the exterior groove 48 of the side hangers 32 and 34 can receive outward extensions 58 and 60 respectively of the vertical spline 56 as shown in FIG. 7. The top hanger 28 and intermediate hanger 38 are spaced from adjacent ends of the side hangers 32 and 34 so that hanger support extension 62 of the horizontal furring 52 can be inserted in the interior groove 50 of the top and intermediate hanger as shown for the top hanger 28 of the bottom panel 26 as viewed in FIG. 2.

Figure 3:
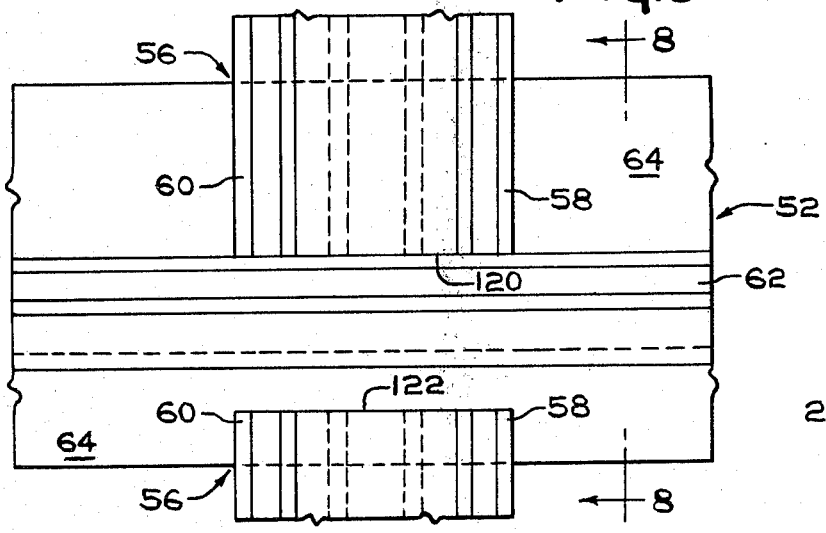
FIG. 3 is a partial front view of the panel support system having the panels removed for showing the side support members of the support system.

With reference to FIGS. 2 and 3 the horizontal furring 52 is preferably a continuous piece having a generally "J" shaped cross section as shown in FIG. 2. With specific reference to FIG. 2, the hanger support extension 62 of the furring 52 is connected to spline support 64 and spaced therefrom by spacing member 66 to provide an upward extending groove 68 for mating the extension 62 of the horizontal furring 52 with the top hanger 28. Beam 70 attached to the spline support 64 of the furring 52 is secured to a plurality of spaced anchors 72 (one shown in FIGS. 2 and 4) to mount the horizontal furring in spaced relation to the former exterior wall 24 of the building 20. Although it is preferred that the horizontal furring 52 be a continuous piece, sections of furring can be used. If sections are used the ends of the furrings preferably adjoin or abut one another behind a panel.

As viewed in FIGS. 2 and 4, the anchor 72 has a vertical arm 74 mounted to the building exterior 24 and a horizontal arm 76 fastened to the beam 70 of the horizontal furring 52. A bolt 78 passes through hole 80 of a rectangular washer 82 and slot 84 in the anchor arm 74 into the building wall 24. The anchor arm 74 and washer 82 have engaging serrated surfaces 86 and 88, respectively, to prevent vertical displacement of the anchor 72 from the dead weight of the panels and/or horizontal and/or vertical furring. The groove 84 in the anchor arm 74 provides for vertical adjustment of the anchor 72 afterwhich the bolt 78 is tightened to secure the anchor 72 in position. The beam 70 of the horizontal furring 52 is secured to the anchor leg 76 by bolt and nut assembly 90 and washer 92. The serrated surface 88 of the washer 92 mates with serrated surface 94 of the furring beam 70 and slot 100 of the furring beam 70 to provide for horizontal adjustment of the furring 52. The engaging serrated surface of the washers 82 and 92, anchor arm 74 and beam 70 eliminate displacement of the joined elements because the serration provide a high friction surface. The anchor 72 of the instant invention may be used to support curtain walls of different construction to buildings, e.g., the curtain wall system taught in U.S. Pat. No. 4,015,388 which teachings are hereby incorporated by reference.

Figure 9:
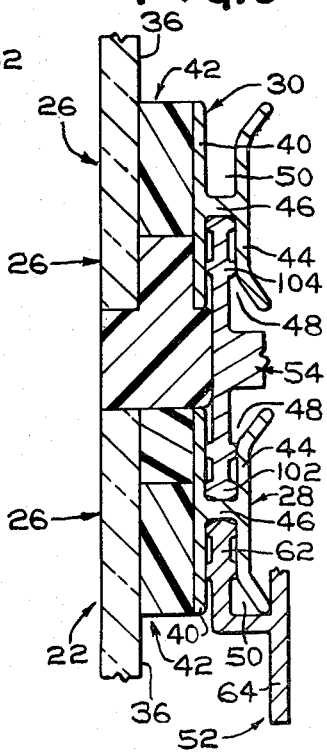
FIG. 9 is a partial side view similar to the view in FIG. 2 illustrating a panel replaced in accordance to the teachings of the invention.

As viewed in FIGS. 2 and 9, the horizontal spline 54 has a bottom extension 102 insertable in exterior groove 48 of the top hanger 28, upper extension 104 insertable in exterior groove 48 of the bottom hanger 30 and a stabilizing arm 106 having groove 108 for receiving end of the spline support 64 of the horizontal furring 52. An outward support ledge 110 shown only in FIG. 2, is provided at selected intervals on the horizontal spline 54 for supporting spacer blocks 112 (only one shown in FIG. 2.) which support bottom edge of the panel 22 as mounted to minimize stress on the adhesive layer 42 supporting the top, bottom and intermediate hangers.

Figure 8:
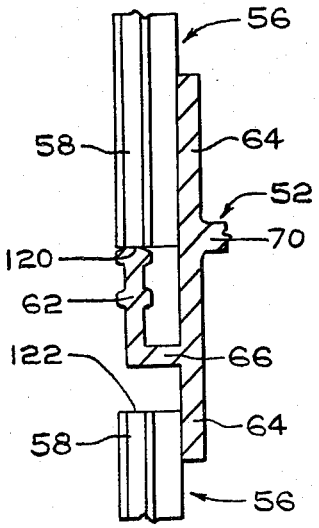
FIG. 8 is a partial side view illustrating the relative position of vertical hangar support members and horizontal hangar support members of the support system.

As shown in FIG. 7, the vertical spline 56 includes the extending side arms 58 and 60 and spacing fingers 118 for aligning the side arms 58 and 60 with the extensions 102 and 104 of the horizontal spline 54 and exterior groove 48 of the side hangers 32 and 34 of adjacent panels 22. As shown in FIGS. 3 and 8, the bottom end 120 of the vertical spline 56 rests on the hanger support extension 62 and on outer surface of the spline support 64 of the horizontal furring 52 as clearly shown in FIG. 8. Upper end 122 of the vertical spline 56 rests on the outer surface of the spline support 64 under the spacer member 66 of horizontal furring as shown in FIG. 8. The vertical spline 56 may be held in position by fastening the ends to the horizontal furring or may rest unfastened on the furring as discussed to minimize or eliminate center and/or end bowing of the panels.

After the panels are secured in position, the spacing between the panels may be filled with an adhesive layer 124 to minimize dust and moisture penetration between the panels. The exposed outer edges of the cladding may be finished in any convenient manner e.g., by a metal channel.

As can now be appreciated, the invention is not limited to the panel material which may be glass, metal or wood, which in turn may be coated or uncoated as well as combinations thereof.

DETAILED DESCRIPTION OF THE INVENTION

The invention is practiced to clad exterior wall 24 of building 20 with glass sheets conveniently coated on one surface e.g. exterior surface, with a reflective coating. Each of the sheets are about 6 feet (1.8 meters) wide, 8 feet (2.4 meters) long and ¼ inch (0.64 centimeter) thick. With reference to FIG. 5, a top hanger 28 intermediate hanger 38 and bottom hanger 30 each having a length of about 5 feet 10¼ inch (1.78 meters) and 4 side hangers 32 and 34 each having a length of about 3 feet 9 1/16 inch (1.15 meters) are provided. The hangers are similar in construction and as shown in FIG. 6 have an "H" shaped cross section including a base 40 having a height of about 1.375 inches (3.5 centimeters) and a facing member 44 having outward sloping ends and a height of about 1.375 inches (3.5 centimeters) spaced from the base 40 by leg 46 to provide an external groove 48 and internal groove 50 each having a width of about 0.250 inch (0.64 centimeter). The thickness of the base, facing member and leg of the hanger is about 0.068 inch (0.17 centimeter).

Referring back to FIG. 5 the hangers 28, 30, 32, 34 and 38 are secured to interior or uncoated surface 36 of the sheet 26 by an adhesive layer 42 which includes (1) a tape 125 of the type sold by Norton Company of Granville, N.Y. P-2112×⅞ inch (2.2 centimeters) and (2) a ⅜ inch (0.9 centimeter) high, ½ inch (1.27 centimeter) wide, bead of silicone of the type sold by General Electric Corp. of Waterford, N.Y. or Dow Corning of Midland, Michigan. As shown in FIG. 5, the top hanger 28 is mounted flush with the top edge of the sheet, the bottom hanger 30 is mounted flush with the bottom edge of the sheet as mounted and the intermediate hanger 38 is mounted on a center to top sheet edge spacing of about 4 feet (1.2 meters). The ends of the hangers 28, 30 and 38 are spaced about ⅞ inch (2.2 centimeters) from adjacent sides of the sheet as mounted. Side hangers 32 and 34 are mounted flush with their respective sides of the sheet between the top hanger and intermediate hanger 38 with the end of the side hangers spaced about ⅞ inch (2.2 centimeter) from the top hanger. A side hanger 32 and 34 is similarly mounted between the bottom and intermediate hanger and spaced about ⅞ inch (2.2 centimeter) from the intermediate hanger.

With reference to FIGS. 2 and 4, anchors 72 are mounted on the exterior of the building at intervals of between about 4 to 8 feet (1.2 to 2.4 meters). The anchors 72 as viewed in FIGS. 2 and 4 have a vertical leg 74 having a height of about 3 inches (7.62 centimeters) a width of about 3 inches (7.62 centimeters) and wall thickness of about ¼ inch (0.64 centimeter) and a horizontal leg 76 having a width of about 3 inches (7.62 centimeters) a length of about 3¼ inches (8.26 centimeters) and a thickness of about ¼ inch (0.64 centimeter). The vertical legs have a vertical slot 84 and the horizontal leg 76 has a slot 98 transverse to the slot 84. Each of the slots have a width of about 25/64 inch (0.99 centimeter) and a length of about 1½ inches (3.81 centimeter). The anchors 72 are mounted on the building surface by a bolt 78 passing through a rectangular washer having serrated surface 88 mating with serrated surface 86 of the leg 74, through the slot 84 and into the building wall 24. The washer 82 has a width of about 1⅛ inches (2.22 centimeters), a length of about 3 inches (7.62 centimeters) and a centrally located hole having a diameter of about 25/64 inch (0.99 centimeter). The serrated surface of the washer and anchor each have 90° angled sides, spaced about ⅛ inch (0.32 centimeter) apart. The anchors are adjusted by way of the slot 84 so that the anchor to support the top hanger is spaced about 3 feet 11⅜ inches (1.2 meters) from the anchor that supports the intermediate hanger and 8 feet ⅜ inch (2.4 centimeters) from the anchor that supports the bottom hanger.

With reference to FIG. 2 the horizontal furring 52 has a generally "J" shaped configuration. Outward extension 62 has a height of about 0.725 inch (1.84 centimeters) and is spaced from spline support 64 having a height of about 2.352 inches (5.97 centimeters) by a spacer member 66 to provide a groove 68 having a depth of about 0.625 inches (1.59 centimeters) and a width of about 0.225 inch (0.65 centimeter). A beam 70 mounted to the spline support 64 is on a center to center spacing of about 1.475 inch (3.75 centimeter) with the bottom end of the spline support as shown in FIG. 2 and on a center to center spacing of about 0.800 inch (2.10 centimeter) with the leg 66. The leg 66 and support extension 62 have a thickness of about 0.100 inch (0.25 centimeter) and the spline support has a thickness of about 0.125 inch (0.32 centimeter). The support extension 62 has a pair of spaced ribs on a center to center spacing of about 0.275 inch (0.7 centimeter), a thickness of about 0.100 inch (0.25 centimeter) and a width of about 0.230 inch (0.58 centimeter) to provide a friction fit when inserted in the grooves of the top, intermediate and bottom hangers. The beam 70 has a thickness of about 0.250 inch (0.635 centimeter), a length of about 2.625 inches (6.67 centimeter). Serrations 88 of the beam mate with serrations 94 of the washer 92 which is similar in dimensions and configuration as the washer 82. The beam has a slot 98 similar to the slot 100 of the anchor leg 76 to provide for lateral adjustment of the beam to allow sheets 26 as shown in FIG. 1 to align in flat planes. The beam and anchor are held together by a nut and bolt assembly 90, and washer 92 as shown in FIG. 2.

The interior groove 50 of the top hanger 28 and bottom groove 50 of the intermediate hanger receive on hanger support extension 62 of a horizontal furring. The bottom hanger 30 of the bottom most mounted panels as shown in FIG. 1 may be mounted on the extension 62 of the horizontal furring 52 (see FIG. 2) or vertical leg of metal angle (not shown) secured in position at the sidewalk level.

With reference to FIGS. 3, 7 and 8, after a panel is mounted at the bottom corner, extension arm 58 of a vertical spline 56 is slid between adjacent horizontal furring into exterior groove of the side members at one side of the panel. The length of the vertical spline 56 is sufficient to have its top end 122 mounted below the arm 66 of the horizontal furring and the bottom end 120 resting on the vertical support 62 as shown in FIG. 8. With reference to FIG. 7 the vertical spline 56 has a width of about 1.625 inches (4.13 centimeters) and a pair of fingers 118 extending from the back surface as mounted. The fingers 118 each have a length of about 0.268 inch (0.68 centimeter), a thickness of about 0.100 inch (0.25 centimeter) and are on a center to center spacing of about 0.275 inch (0.7 centimeter) about the longitudinal center of the spline 56. Each extension 58 and 60 is provided with a pair of spaced ribs having a thickness of about 0.230 inch (0.58 centimeter) to provide frictional engagement with exterior groove of the side hangers.

With reference to FIG. 2, after the bottom row of panels are mounted, a horizontal spline 54 is mounted in the exterior groove of the top hanger 28 of the mounted panels and on the spline support 64 of the horizontal furring 52. The length of the horizontal spline 54 is approximately the same length as the top hanger. The horizontal spline has a height of about 1.625 inches (4.13 centimeters) as measured between the ends of the extensions 102 and 104. The extensions have a thickness of about 0.100 inch (0.25 centimeter) and a pair of spaced ribs each about 0.230 inch (0.58 centimeter) to provide a friction fit with the exterior groove of the top and bottom hangers. The horizontal spline 54 has a groove in arm 55 sized such that the extension 58 and 60 of the vertical spline 56 (see FIG. 7) and extension 102 and 104 of the horizontal spline 54 and exterior groove 48 of the top hangers 28 are aligned when the horizontal spline 54 is mounted as shown in FIG. 2. The arm 55 has a thickness of about 0.375 inches (0.95 centimeter). Spaced ledges 110 (shown only in FIG. 2) for supporting the bottom edge of the glass panels as mounted have a thickness of about 0.125 inch (0.318 centimeter); a length of 0.705 inch (1.79 centimeters) and a length of about 6 inches (15.24 centimeters). The ledges 110 on a center to center spacing of about 3 feet (0.9 meter) are provided intermediate the ends of the extensions 102 and 104 of the horizontal spline 54.

A spacer block 112 having a length of about 0.705 inch (1.8 centimeters), a height of about ⅛ inch (0.32 centimeter) and a length of about 6 inches (15.24 centimeters) and made of silicone is mounted on each ledge. Thereafter a second row of panels are mounted by placing the bottom hanger 30 onto the horizontal spline 54 and the intermediate and top hanger onto the horizontal furring 52 as previously discussed. Vertical splines 56 are provided between the panels as previously discussed. The above is repeated until the wall of the building is clad. An open-cell polyurethane backer 127 (shown only in FIG. 7) is provided between the panels after which silicone 124 is flowed to completely fill the space between adjacent edges of the mounted panel and the exterior edge portions of the panels are dressed in any convenient manner.

Damaged panels are replaced by removing the silicone 124 and backer 127 around the damaged unit and the hangers. New or cleaned old hangers are mounted in place of the removed hangers. Norton tape is mounted on the hangers after which a sheet mounted on the support blocks 112 and urged against the tape. Thereafter a layer of silicon is applied around the newly installed sheet and flowed between the hanger and interior surface of the sheet and into the spacing between the sheets as shown in FIG. 9.

As can be appreciated the invention is not limited to the above examples which are presented for illustration purposes only.

What is claimed is:

1. A panel for use in cladding systems comprising:

a sheet having at least one major surface and four sides designated as a top side, a bottom side, a left side and a right side;

a plurality of hangers each having a first side and a second opposite side;

at least one of said hangers as viewed in cross-section has two opposed grooves at least a portion of each groove in the same plane between its first and second sides;

at least one other of said hangers as viewed in cross-section has at least one groove between its first and second sides; and means for securing the first side of said hangers to said sheet with a hanger adjacent to each of the top side, the bottom side and the right and left sides, said hanger adjacent to the right and left sides terminates short of said hanger adjacent the top side.

2. The panel as set forth in claim 1 wherein said hangers are flush with their adjacent side of said sheet.

3. The panel as set forth in claim 1 wherein the sheet is a glass sheet.

4. The panel as set forth in claim 1 further including a hanger intermediate said top and bottom hangers.

5. The panel as set forth in claim 1 wherein said securing means includes an adhesive.

6. A system for cladding exterior surface of a building, comprising:

a plurality of panels each having a major surface and opposed sides designed as a top side and a bottom side;

a hanger secured to each of said panels adjacent the top side to provide a top hanger, said top hanger as viewed in cross-section having an interior facing groove and an exterior facing groove;

a hanger secured to each of said panels adjacent the bottom side to provide a bottom hanger, said bottom hanger as viewed in cross-section having an exterior facing groove;

support means including a first upright and a second upright spaced from the first upright, the second upright of said support means insertable in the interior facing groove of said top hangar;

spline means secured to the first upright of said support means and having a first leg insertable in exterior facing groove of said top hanger and a second leg insertable in exterior facing groove of said bottom hanger of adjacent top panel; and means for securing said support means to the building exterior.

7. The system as set forth in claim 6 wherein each of said panels has a second pair of opposed sides and further including:

a hanger secured to each of said panels at each of the second pair of opposed sides to provide side hangers, each of said side hangers having an exterior facing groove; and said spline means is horizontal spline means and further including vertical spline means insertable in the exterior facing groove of said side hangers of adjacent panels.

8. The system as set forth in claim 7 wherein the side hangers terminate short of the top hanger.

9. The system as set forth in claim 8 wherein the panels are glass panels and the hangers are secured to the glass panels by an adhesive.

10. The system as set forth in claim 9 further including a hanger intermediate the top and bottom hangers.

* * * * *

UNITED STATES PATENT AND TRADEMARK OFFICE

CERTIFICATE OF CORRECTION

PATENT NO. : 4,307,551

DATED : December 29, 1981

INVENTOR(S) : Stephen L. Crandell

It is certified that error appears in the above-identified patent and that said Letters Patent are hereby corrected as shown below:

Claim 3, line 1, after "1" insert --or 2--.

Claim 4, line 1, after "1" insert --or 2--.

Claim 5, line 1, after "1" insert --or 2--.

Signed and Sealed this

*Thirteenth* Day of *July 1982*

[SEAL]

*Attest:*

GERALD J. MOSSINGHOFF

*Attesting Officer*

*Commissioner of Patents and Trademarks*